US007044447B2

(12) United States Patent
Cano et al.

(10) Patent No.: US 7,044,447 B2
(45) Date of Patent: May 16, 2006

(54) RETRACTABLE BARBED BARRIER SYSTEM

(76) Inventors: Renne Cano, 3636 W. Buckeye Rd., Phoenix, AZ (US) 85009; Steven John Cano, 3636 W. Buckeye Rd., Phoenix, AZ (US) 85009

( * ) Notice: Subject to any disclaimer, the term of this patent is extended or adjusted under 35 U.S.C. 154(b) by 0 days.

(21) Appl. No.: 10/692,967

(22) Filed: Oct. 24, 2003

(65) Prior Publication Data

US 2004/0149975 A1 Aug. 5, 2004

Related U.S. Application Data

(60) Provisional application No. 60/429,959, filed on Dec. 2, 2002.

(51) Int. Cl.
*E04H 17/04* (2006.01)

(52) U.S. Cl. ..... 256/5; 256/2; 256/33; 256/45; 49/50; 49/56; 160/104

(58) Field of Classification Search ..... 256/1, 256/2, 5, 32, 33, 45; 52/670, 106, 786.11, 52/204.61; 49/50, 56, 34; 160/199, 207, 160/104, 159, 161

See application file for complete search history.

(56) References Cited

U.S. PATENT DOCUMENTS

| | | | | | |
|---|---|---|---|---|---|
| 1,920,416 | A | * | 8/1933 | Melaun | 160/159 |
| 2,990,880 | A | * | 7/1961 | Catalano et al. | 160/162 |
| 3,845,804 | A | * | 11/1974 | Romberg | 160/328 |
| 4,484,729 | A | * | 11/1984 | Mainiero et al. | 256/1 |
| 4,666,129 | A | | 5/1987 | Dobson | |
| 4,887,796 | A | | 12/1989 | Cano et al. | |
| 5,437,134 | A | * | 8/1995 | Donnelly | 52/507 |
| 5,787,642 | A | * | 8/1998 | Coyle et al. | 49/61 |

OTHER PUBLICATIONS

Detainer Hook Barb, American Security Fence catalog, date unknown.

* cited by examiner

*Primary Examiner*—Daniel P. Stodola
*Assistant Examiner*—Michael P. Ferguson
(74) *Attorney, Agent, or Firm*—Etherton Law Group, LLC

(57) ABSTRACT

A barrier system utilizing cutters that have been connected into strips, with the strips connected to form a substantially planar barrier sheet. The barrier sheet may be encased by breakable separators, which cover the cutters to prevent inadvertent injury but expose the cutters when broken upon an attempt to penetrate the barrier. The barrier may be retracted into an opening, preferably into a concealed compartment.

14 Claims, 8 Drawing Sheets

100

RETRACTABLE BARBED BARRIER SYSTEM

CROSS-REFERENCE TO RELATED APPLICATION

The present application claims priority to U.S. provisional patent application Ser. No. 60/429,959, filed Dec. 2, 2002, entitled "Expandable and Retractable Barbed Tape Concertina Barrier for Door and Window Enclosures."

FIELD OF INVENTION

This invention relates generally to building structures adapted to serve the purposes of a barrier. This invention relates particularly to expandable and retractable barbed barriers.

BACKGROUND

Typically, barriers, such as windows, walls, bars, fences, and doors, are used to physically block openings. Such barrier systems are inadequate because they inhibit visibility, fail to deter potential intruders, fail to retract, create a risk of inadvertent injury, and can require significant expenditures of time, money, and energy. For example, non-transparent barriers, such as walls, fail to provide visibility to the other side of the barrier. Non-cutting barriers, such as bars, fail to deter attempts at penetration because they do not create a risk of injury to a potential intruder. Non-retractable barriers, such as walls, do not retract and generally must be completely destroyed in order to remove them from a specific location. Non-separated barriers, such as barbed wire concertina, create a substantial risk of injury to parties not attempting to intrude. Furthermore, the use of shatter-proof glass, security guards, and guard dogs, can require significant expenditures of time, money, and energy. As a result, a barrier system capable of increased visibility, increased deterrence, increased retractability, decreased risk of injury, and decreased use of resources, would be highly desirable.

A primary object and feature of the present invention is to provide an improved barrier system. It is a further object and feature of the present invention to provide a barrier system capable of providing visibility. Another object of the present invention to provide a system that deters potential intruders from penetrating an opening. Another object of the present invention is to provide a system capable of retracting. Other objects and features of this invention will become apparent with reference to the following descriptions.

SUMMARY OF THE INVENTION

The present invention is a barrier system utilizing cutters, which cut objects attempting to penetrate an opening. The cutters are connected into strips, and the strips are connected to form a substantially planar barrier sheet. The barrier sheet may be encased by breakable separators, which cover the cutters to prevent inadvertent injury but expose the cutters when broken upon an attempt to penetrate the barrier. The barrier may be retracted into an opening, preferably into a concealed compartment.

DETAILED DESCRIPTION OF THE INVENTION

Figure 2:
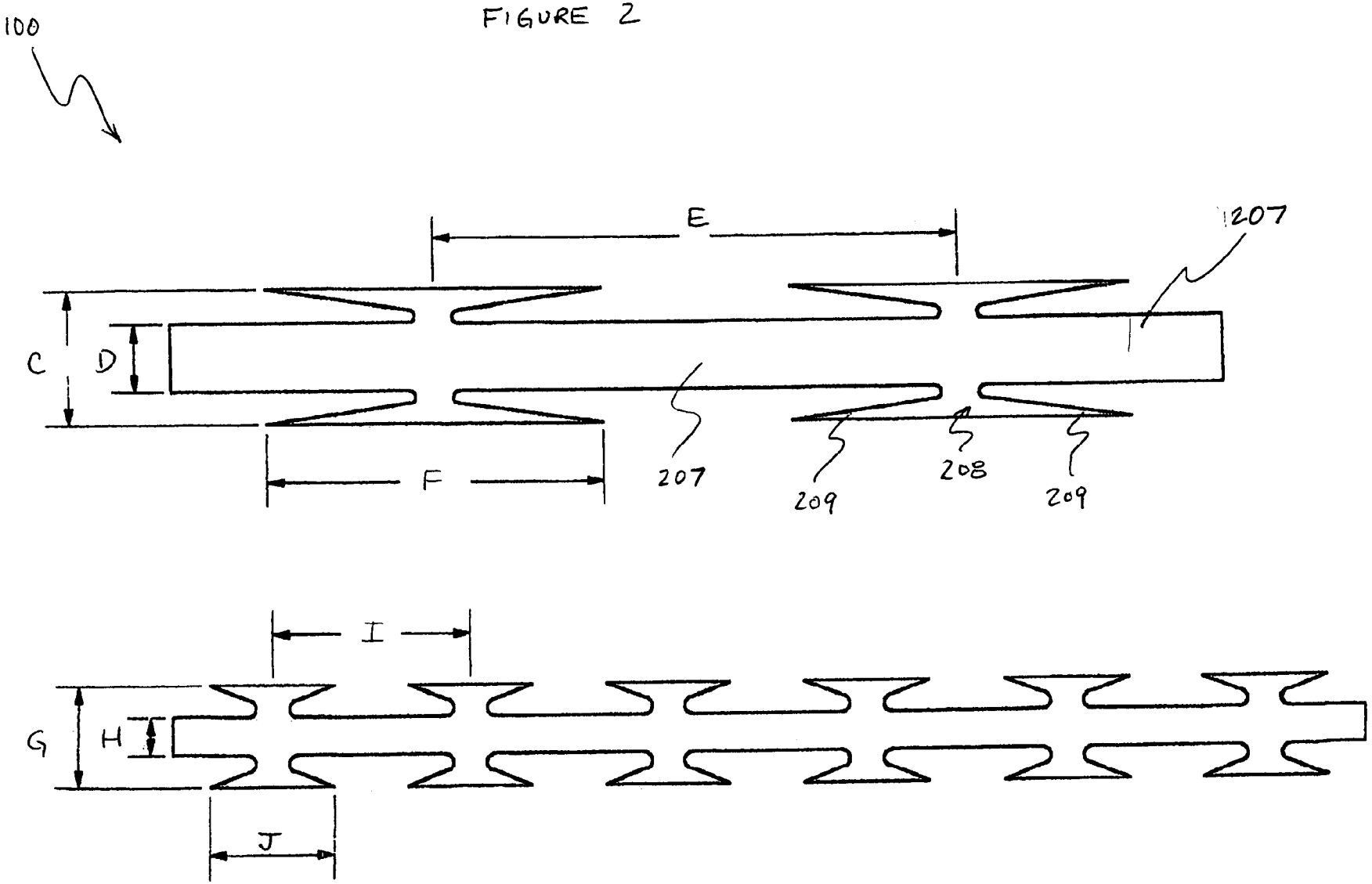
FIG. 2 is a top view of a strip showing the cutters.
Figure 3:
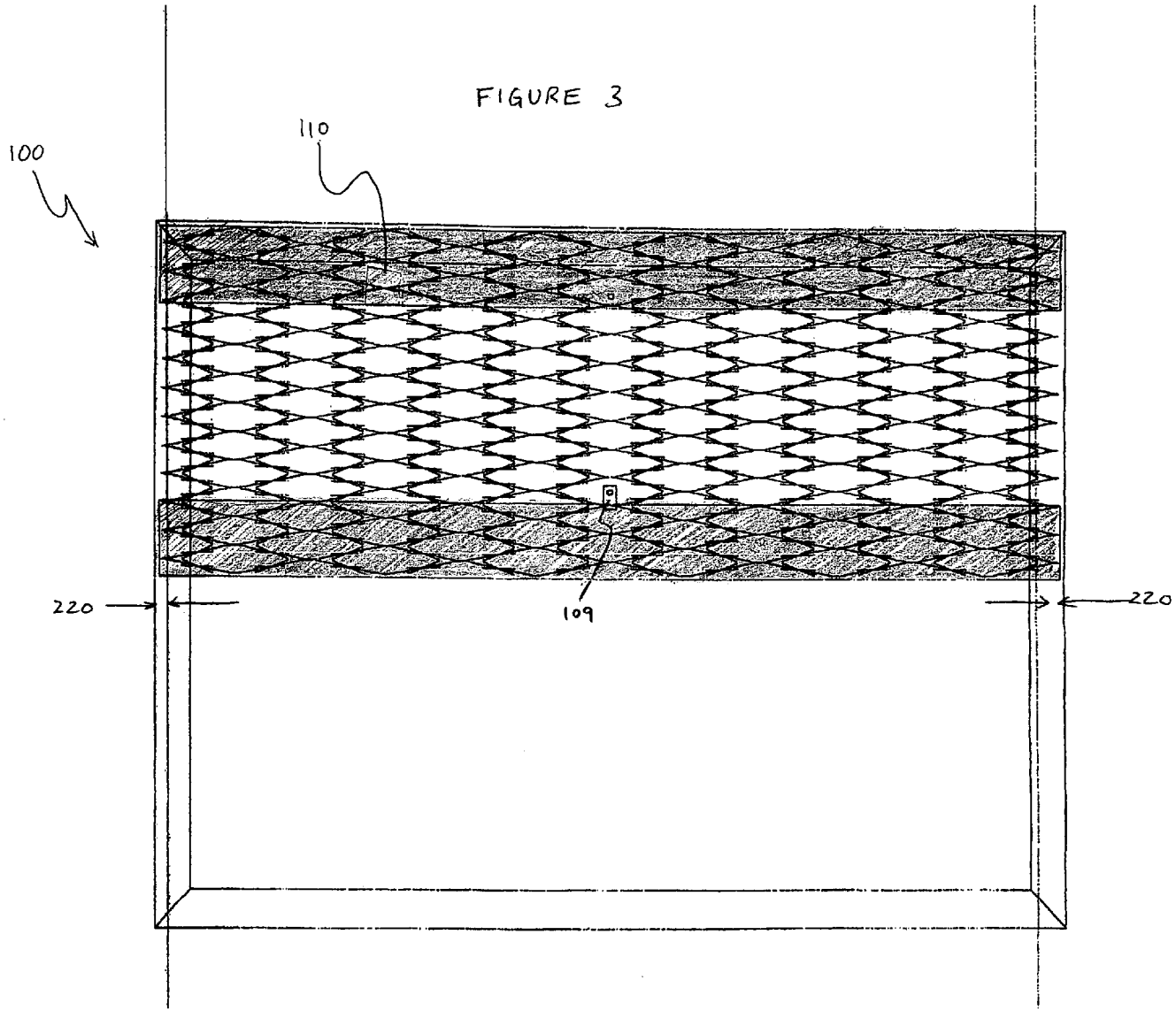
FIG. 3 is a front view of a partially-retracted barrier.
Figure 4:
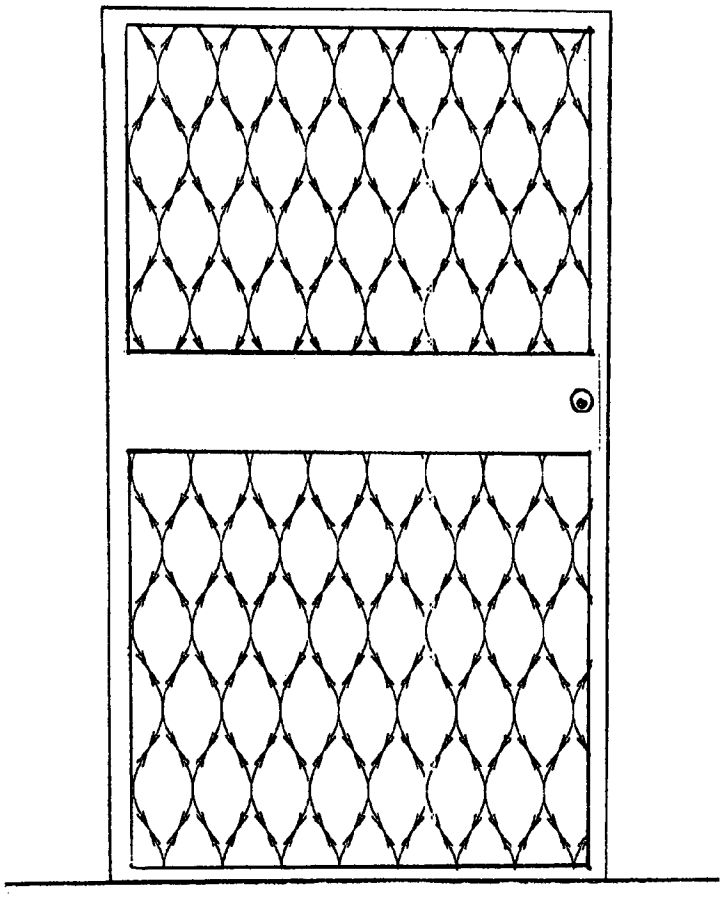
FIG. 4 is a front view of the barrier system installed in a door frame.

Referring to FIGS. 1–9, system 100 comprises cutters 102 and connectors 104. Connectors 104 are utilized to connect cutters 102, forming a barrier capable of blocking an opening, such as a storefront window or doorway, from penetration by various objects such as animals, people, and weapons, as shown in FIG. 4. System 100 may also comprise a separator 106, capable of separating cutters 102 from their surroundings, so as to prevent accidental cutting of proximately moving objects. System 100 may also comprise a retractor 108 and retraction compartment 110, for moving cutters 102 in and out of the opening. Preferably, cutters 102 are razors that are used on razor wire. Altematively, cutters 102 can be barbs, such as those extending from barbed wire or those extending from barbed tape, as is known in the art. Under appropriate circumstances, considering issues such as cost, manufacturing, local laws, etc., cutters may be fashioned from other materials, such as sharpened strips of plastic.

The cutters are connected to form strips 207. Preferably the cutters 102 are integral with the connectors 104, such as the case with barbed wire or barbed tape, but the cutters may be connected by separate connectors. The preferred distance E between cutters 102 is about 4 inches, as shown in FIG. 2.

Figure 1:
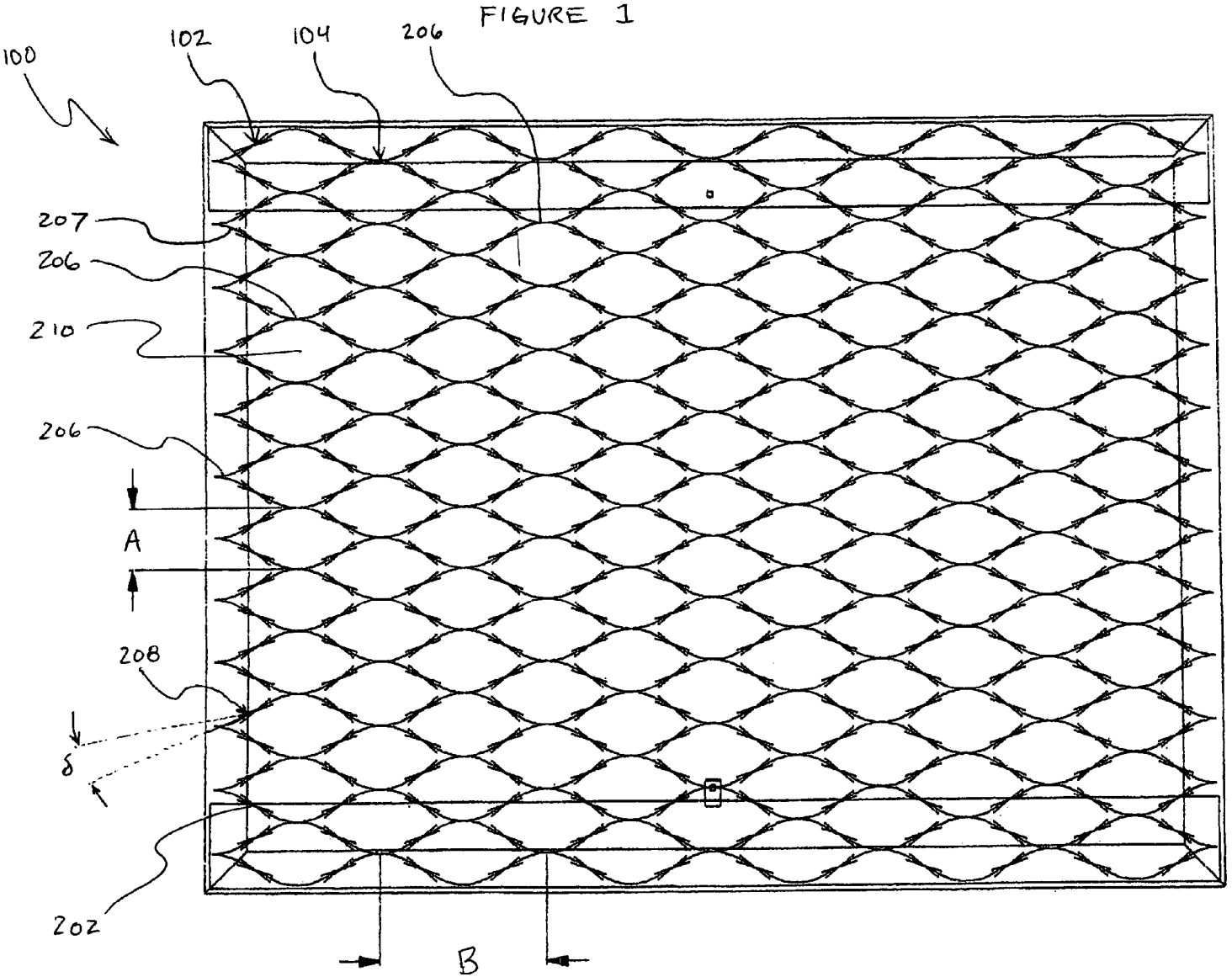
FIG. 1 is a front view of the barrier system according to a preferred embodiment.
Figure 9:
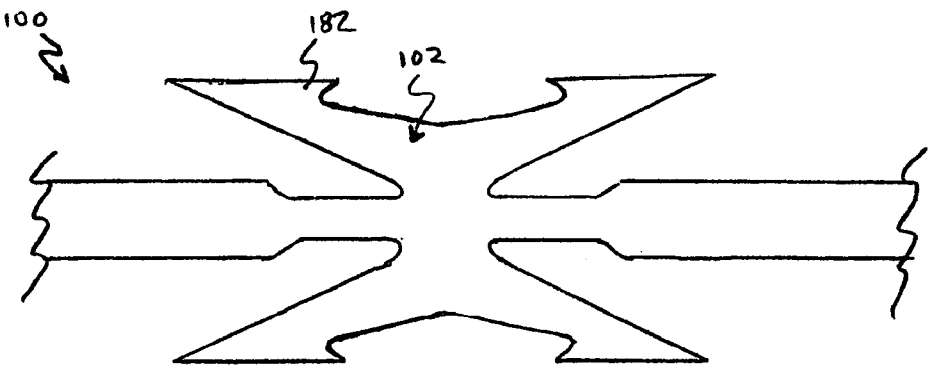
FIG. 9 is a top view of a cutter with retained barbs.

A plurality of strips 207 is connected to each other to form an accordion-like barrier sheet. Preferably the strips 207 are connected to each other utilizing rivets 206 at spaced locations. The preferred distance B between rivets 206 is about 8 inches, as shown in FIG. 1. Under appropriate circumstances, considering issues such as mechanical failure, cost, manufacturing, etc., bandings, tape, hooks, clips, tie-offs, or spot welds may be used to connect the strips to each other. When the sheet is expanded, the distance A between cutters 102 is preferably about 3 inches, as shown in FIG. 1. An alternative cutter 102, having a retainer barb 182, is shown in FIG. 9. This cutter is also known in the art as a detainer hook barb.

Figure 5:
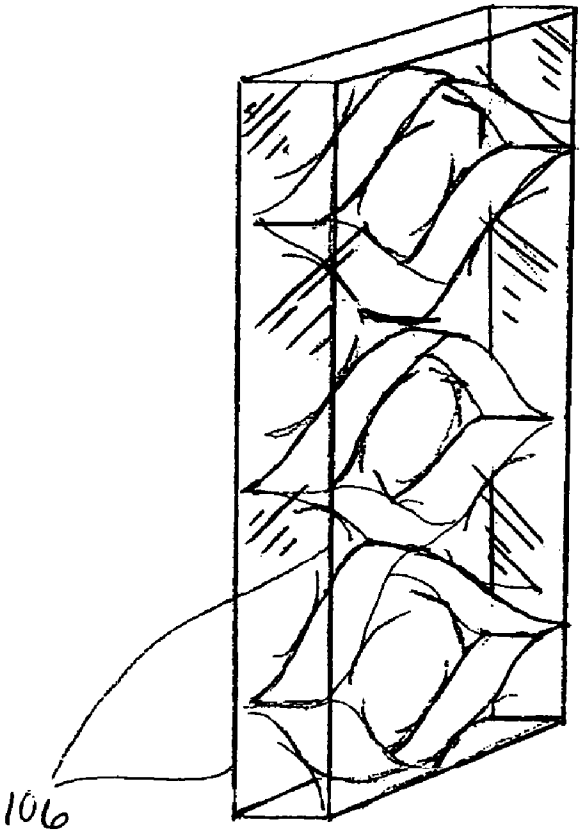
FIG. 5 is a perspective view of a portion of the barrier sandwiched between separators.
Figure 6:
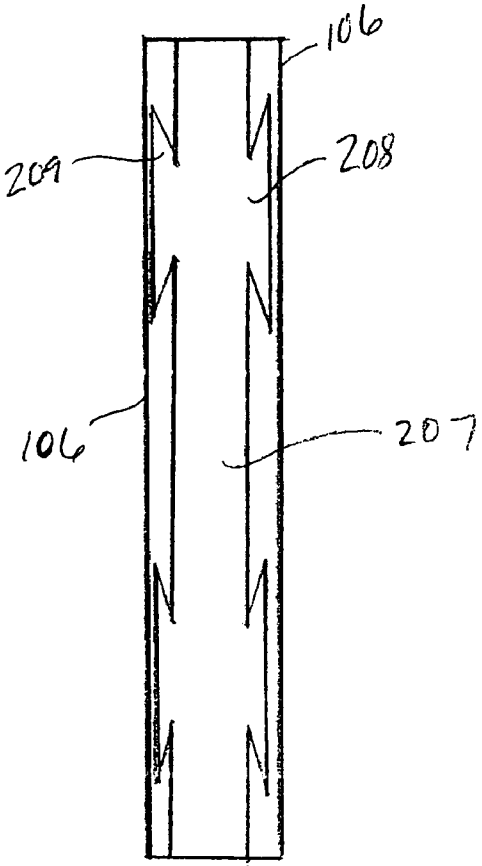
FIG. 6 is a top view of a portion of the barrier sandwiched between separators as shown in FIG. 5

The barrier sheet is substantially planar, but has many exposed, sharp edges which may be dangerous to innocent passers-by. To prevent inadvertent injury, the barrier sheet may be separated from its surrounding by a breakable protective sheet. The sheet prevents inadvertent injury when whole, but exposes the cutters when broken. Preferably, separator 106 comprises two planar sheets of material which sandwich the cutters 102, on both sides, as shown in FIG. 5 and FIG. 6. A separator 106 facing only one side of the cutters 102 may also be used. Preferably, separator 106 is a transparent or porous material, so as to provide for visibility through the barrier. Preferably, separator 106 is made of glass panes 210. Under appropriate circumstances, considering issues such as cost, manufacturing, security, visibility, etc., other separators 106, such as plastic panes, drywall, bricks, bulletproof materials, etc., may suffice.

FIG. 2 is a top view of a cutter. Preferably, system 100 comprises a distance C of about 1 inch, a distance D of about 0.5 inches, a distance E of about 4 inches, and a distance F of about 2.5625 inches. Preferably, the two tips 209 of barb 208, as shown in FIG. 2, are bent at an angle δ of 10 degrees outside the plane of the strip, in opposite directions on the same barb, as shown most clearly in FIG. 8. Alternatively, system 100 may comprise a distance G of about 0.75 inches, a distance H of about 0.25 inches, a distance I of about 1.5 inches, and a distance J of about 0.9375 inches, as shown in FIG. 2. Preferably, the base of the tips 209 have cut-outs 212 that narrow at the barb roots.

Figure 7:
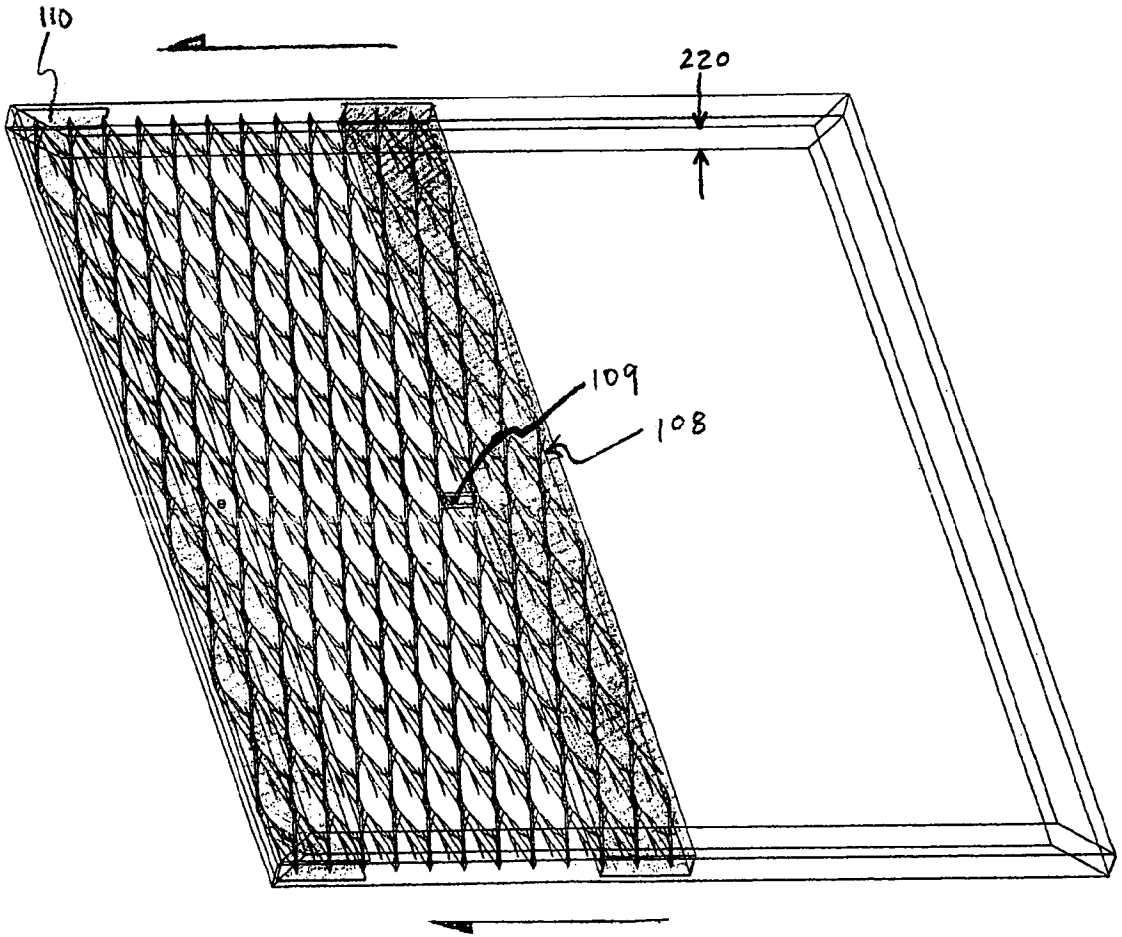
FIG. 7 is a perspective view of a partially-retracted barrier.
Figure 8:
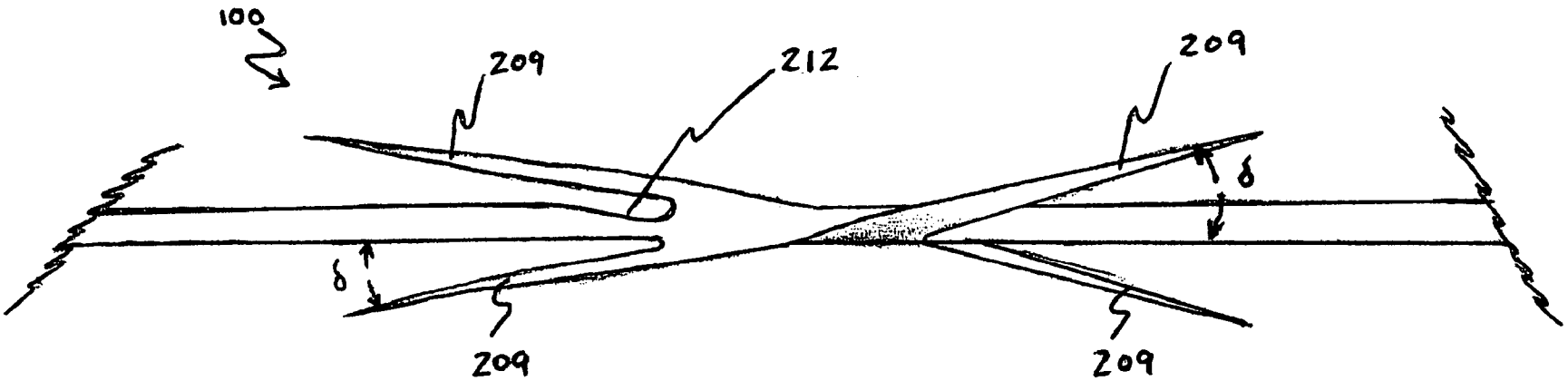
FIG. 8 is a side view of a cutter.

FIG. 3 is a front view of a partially-retracted barrier. The retractor 108 is any mechanism capable of pulling cutters 102 in and out of the opening. Preferably, retractor 108 retracts into a hollow compartment 110, as shown in FIG. 3. The barrier may retract into the compartment in its expanded form, or it may be compressed to fit into a smaller compartment. Preferably, retractor 108 is a manual retraction system, whereby a user slides the barrier into compartment 110, utilizing handle 109, which compresses the strips 207 of cutters 102 upon themselves, like an accordion, as shown in FIG. 7. Preferably, a gap 220 exists between the side edges of the cutters 102, and the side edges of the opening, in order to account for expansion as the cutters 102 compress into a retracted position. Under appropriate circumstances, considering issues such as space surrounding the opening, cost, manufacturing, etc., other retractors 108, such as automated pulling, automated pushing, single removable cutter sheets, etc., may suffice.

Although the above descriptions provide applicant's preferred embodiments of this invention, it will be understood that the broadest scope of this invention includes such modifications as diverse shapes and sizes, as well as diverse materials and colors. In addition, equivalents may be substituted for elements thereof without departing from the true scope of the invention. Such scope is limited only by the below claims as read in connection with the above specification. Furthermore, many other advantages of applicant's invention will be apparent, to persons of ordinary skill in the art, as a result of the above descriptions and as a result of the below claims.

What is claimed is:

1. A barrier system comprising:

a) a frame with a top, bottom, and two side portions which define an opening with an interior and exterior side;

b) a planar barrier disposed within the frame comprised of a plurality of strips with barbs that is operable in the plane between an extended condition whereby the planar barrier substantially covers the opening and a retracted condition whereby the planar barrier does not substantially cover the opening;

c) a first barrier sheet attached to the interior side of the frame to cover the planar barrier; and d) a second barrier sheet attached to the exterior side of the frame to cover the planar barrier.

2. The system of claim 1 wherein the top portion of the frame is a ceiling, the bottom portion is a floor, and the two side portions are walls.

3. The system of claim 1 wherein the first barrier sheet is glass.

4. The system of claim 1 wherein the first barrier sheet is plastic.

5. The system of claim 1 wherein the frame is a doorway.

6. The system of claim 1 further comprising a retraction compartment located on the frame that can receive the planar barrier when it is in the retracted condition.

7. The system of claim 6 wherein the retraction compartment is located on the top portion of the frame.

8. A barrier system to prevent access through an opening comprising:

a) a frame with a top, bottom, and two side portions which define an opening with an interior and exterior side;

b) a planar barrier disposed within the frame comprised of a plurality of strips with razors that is operable in the plane between an extended condition whereby the planar barrier substantially covers the opening and a retracted condition whereby the planar barrier does not substantially cover the opening;

c) a first barrier sheet attached to the interior side of the frame to cover the planar; and d) a second barrier sheet attached to the exterior side of the frame to cover the planar barrier.

9. The system of claim 8 wherein the planar barrier folds into equal sized, flat segments when in the retracted condition.

10. The system of claim 8 wherein at least one barrier sheet is glass.

11. The system of claim 8 wherein at least one barrier sheet is plastic.

12. The system of claim 8 further comprising a retraction compartment that can receive the planar barrier when it is in the retracted condition.

13. The system of claim 8 further comprising a retraction compartment located on the top portion of the frame that can receive the planar barrier when it is in the retracted condition.

14. A barrier system attached to an opening of a building for preventing access through the opening comprising:

a) a frame with an interior side and an exterior side that is defined by a top ceiling portion, a bottom floor portion, and two side portions;

b) a planar barrier located between the interior and exterior sides of the frame comprised of a plurality of strips with a plurality of razors wherein the planar barrier is operable in the plane between an extended condition whereby the planar barrier substantially covers the opening and a retracted condition whereby the planar barrier does not substantially cover the opening; and c) a first barrier sheet attached to the interior side of the frame to cover the planar barrier; and d) a second barrier sheet attached to the exterior side of the frame to cover the planar barrier.

* * * * *